US007052320B2

(12) United States Patent
Zhang et al.

(10) Patent No.: US 7,052,320 B2
(45) Date of Patent: May 30, 2006

(54) ELECTRICAL CONNECTOR HAVING SHIELDING PLATES

(75) Inventors: Chi Zhang, Kunsan (CN); Jerky Zhang, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/935,817

(22) Filed: Sep. 7, 2004

(65) Prior Publication Data

US 2005/0042924 A1 Feb. 24, 2005

(30) Foreign Application Priority Data

Sep. 6, 2003 (CN) ..... 03 2 78409

(51) Int. Cl.
*H01R 13/648* (2006.01)

(52) U.S. Cl. ..... 439/607

(58) Field of Classification Search ..... 439/607–610, 439/108, 101

See application file for complete search history.

(56) References Cited

U.S. PATENT DOCUMENTS

| | | | | |
|---|---|---|---|---|
| 6,033,236 | A | 3/2000 | McHugh et al. | |
| 6,394,841 | B1 | 5/2002 | Matsuura | |
| 6,503,101 | B1 | 1/2003 | Yu | |
| 6,551,139 | B1 | 4/2003 | Yu | |
| 6,685,508 | B1 * | 2/2004 | Zhu et al. | 439/607 |

* cited by examiner

*Primary Examiner*—Javaid H. Nasri
(74) *Attorney, Agent, or Firm*—Wei Te Chung

(57) ABSTRACT

An electrical connector (1) has an insulative housing (10), a number of terminals (40) received in the insulative housing, a pair of shielding plates (20) attached to the sides of the housing and a pair of reinforcing plates (30) assembled on opposite ends of the housing and electrically connecting with the shielding plates. The housing includes a pair of side walls (12), a receiving space (11) defined between the side walls and a number of cutouts (17) defined along upper edges of the side walls. Each shielding plate has an elongated base portion (21) forming a number of spring tabs (26) engaging with the cutouts of the housing and exposed in the receiving space.

8 Claims, 4 Drawing Sheets

ELECTRICAL CONNECTOR HAVING SHIELDING PLATES

BACKGROUND OF THE INVENTION

1. Field of the Invention

The present invention relates to an electrical connector, and particularly to an electrical connector having shielding plates.

2. Description of Prior Arts

U.S. Pat. No. 6,394,841 discloses an electrical connector comprises a plurality of shield plates on two longitudinal sides of an insulative housing and a plurality of reinforcing plates made of metal on two opposite ends of the housing. The shield plates and the reinforcing plates electrically contact with each other. There are a plurality of elongated windows provided along an upper end of the shield plate. A beam portion is formed between both ends of the window and the upper end of the shield plate. The beam portion is flexible in the direction of a thickness of the shield plate. A contact section is provided in the middle of the beam portion to make spring contact with a shielding plate of a mating complementary connector. A plurality of retainers are provided on outer side of the housing for attaching the shielding plate. A plurality of grounding sections are provided on a lower end of the plate.

A problem has been found when the basic structure of the low profile connector disclosed in the aforementioned U.S. Patent is applied to the high profile design. The problem is that because the windows are provided along the upper end of the shield plate, the shielding plate is so infirm and easy to be broken, especially when the complementary connector mates with said connector repeatedly.

Hence, it is desirable to have an improved electrical connector to overcome the above-mentioned disadvantages of the prior art.

SUMMARY OF THE INVENTION

It is an object of the present invention to provide an electrical connector that can attach shielding plates tightly to an insulative housing thereof.

In order to achieve the above-mentioned object, an electrical connector in accordance with the present invention has an insulative housing, a number of terminals received in the insulative housing, a pair of shielding plates attached to the sides of the housing and a pair of reinforcing plates assembled on opposite ends of the housing and electrically connecting with the shielding plates. The housing includes a pair of side walls, a receiving space defined between the side walls and a number of cutouts defined along upper edges of the side walls. Each shielding plate has an elongated base portion and a number of spring tabs engaging with the cutouts of the housing and exposed in the receiving space.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
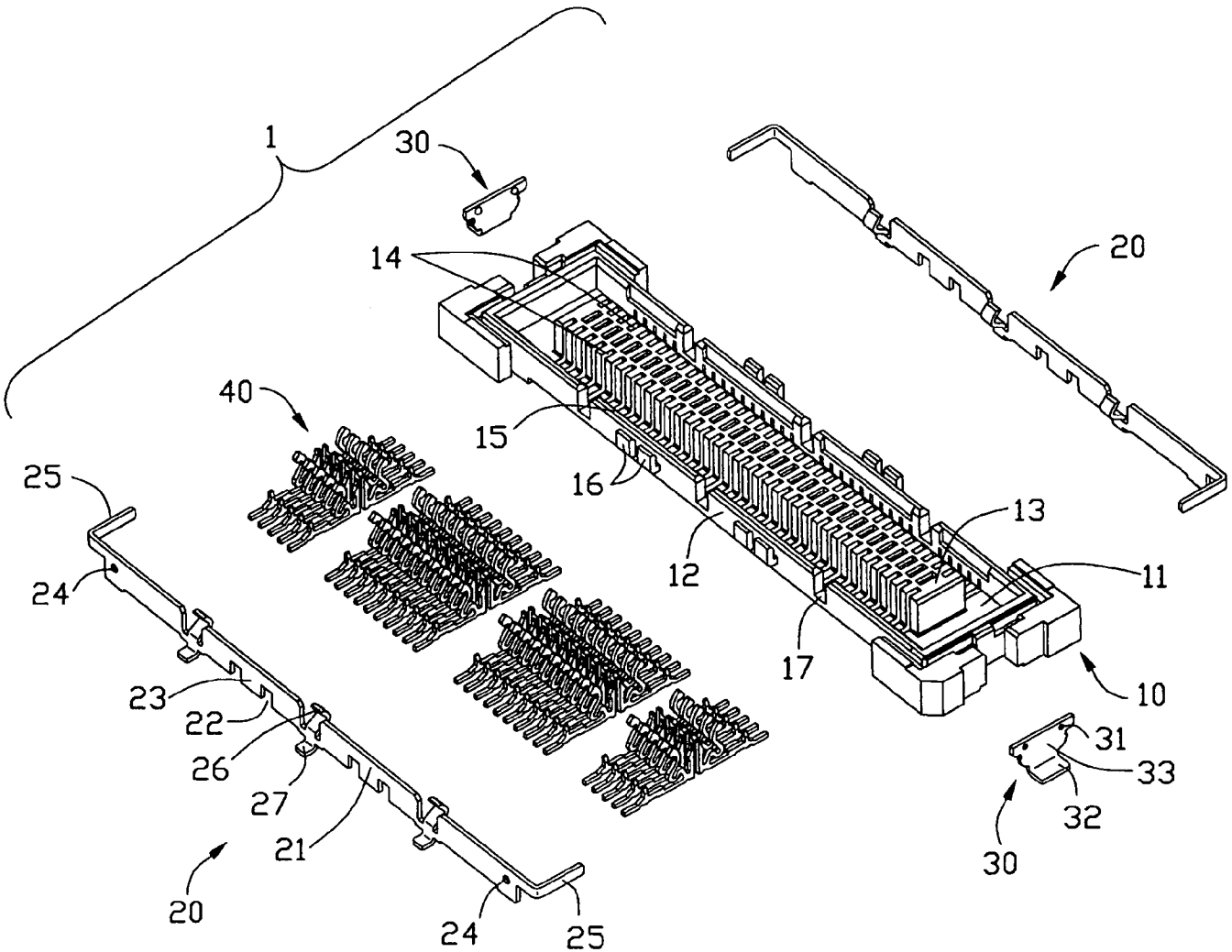
FIG. 1 is an exploded, perspective view of an electrical connector in accordance with the present invention.
Figure 2:
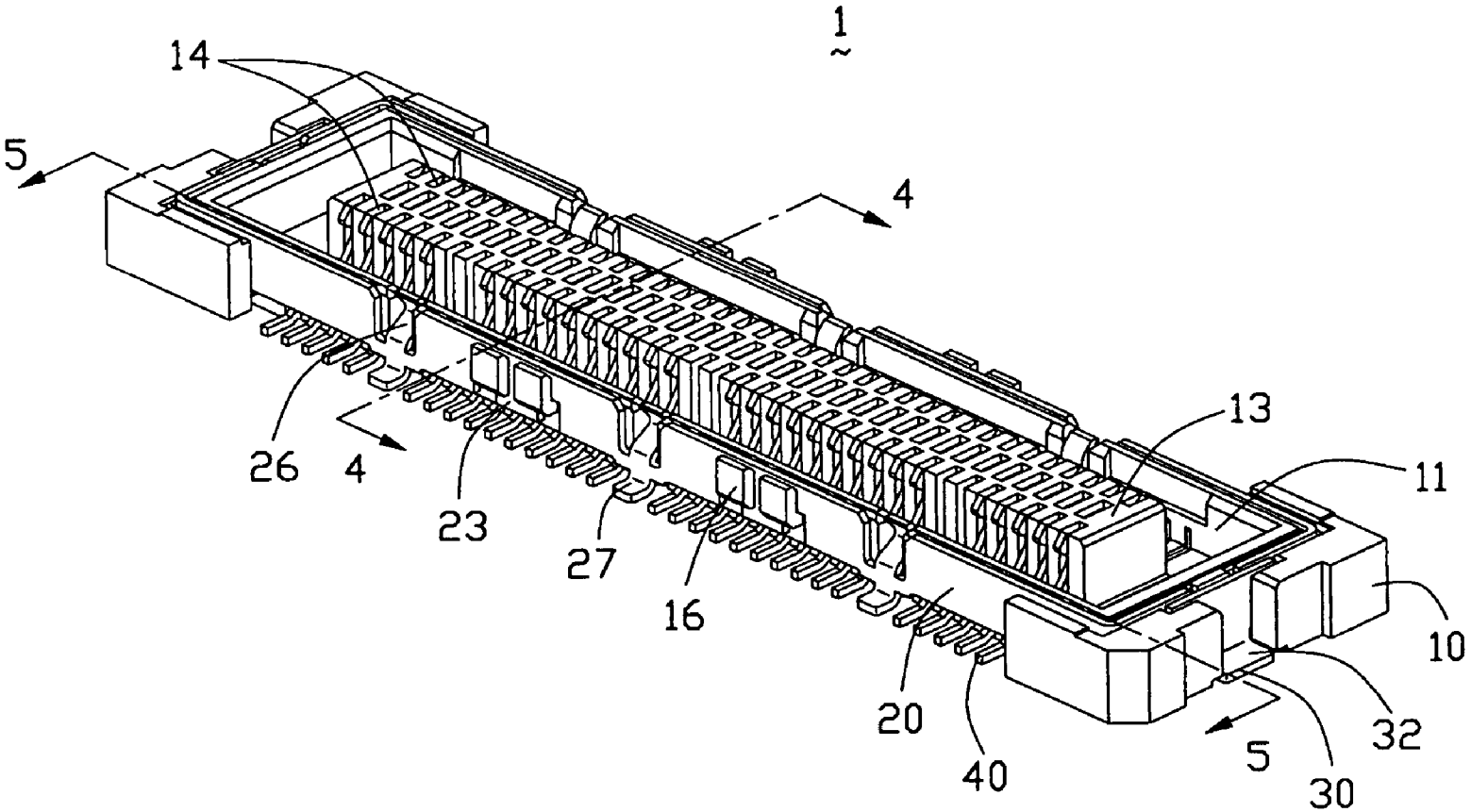
FIG. 2 is an assembled perspective view of the connector shown in FIG. 1.
Figure 3:
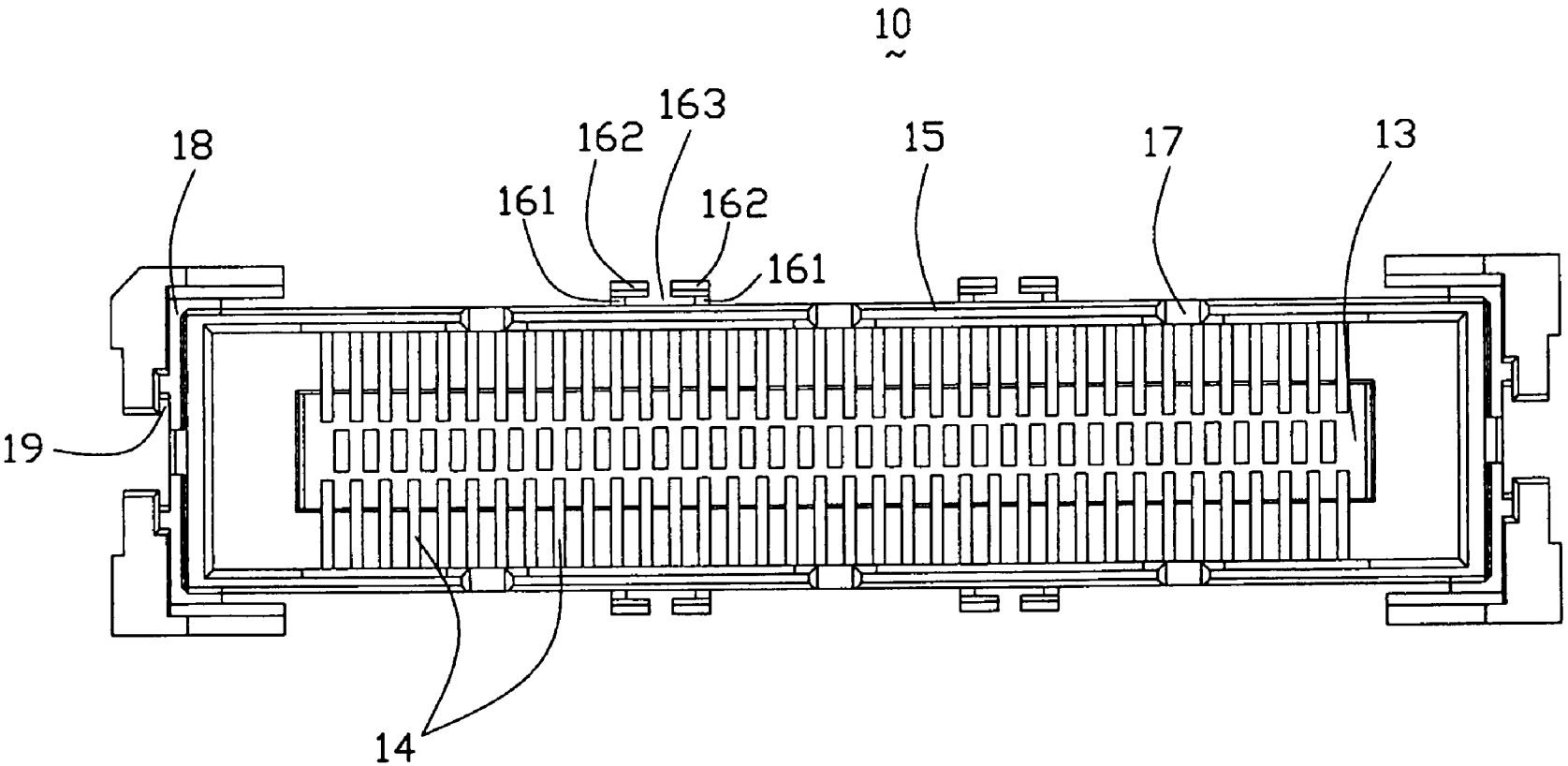
FIG. 3 is a top view of an insulative housing of the connector shown in FIG. 1.
Figure 4:
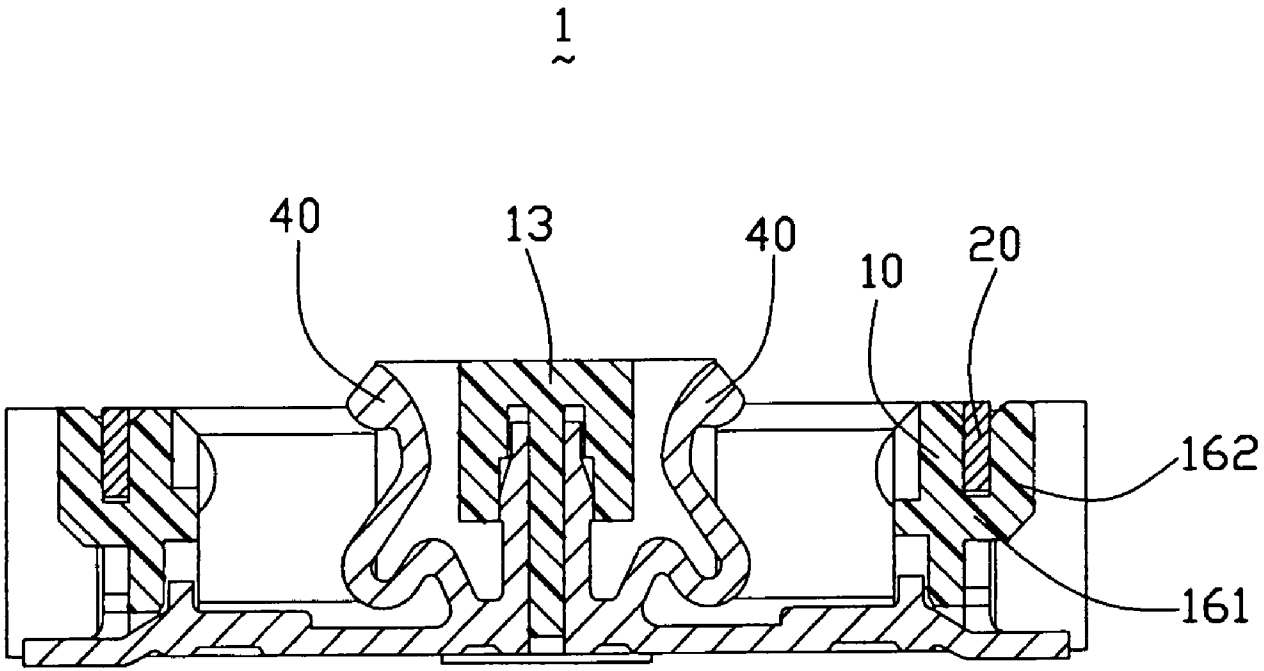
FIG. 4 is a cross-sectional view of the electrical connector of FIG. 2 taken along line 4—4.

With reference to FIGS. 1, 2 and 3, an electrical connector 1 in accordance with the present invention comprises an insulative housing 10, a pair of shielding plates 20 attached to longitudinal sides of the housing 10, a pair of reinforcing plates 30 assembled on opposite ends of the housing 10, and a plurality of terminals 40 received in the housing 10.

The insulative housing 10 comprises a pair of opposite, longitudinal side walls 12, and a tongue section 13 extending between the side walls 12, and defines a receiving space 11 and a plurality of passageways 14 on opposite side of the tongue section 13. Each side wall 12 has a plurality of cutouts 17 defined along an upper edge 15 thereof. A plurality of pairs of retainers 16 extend from outer faces of the side walls 12. Each retainer 16 comprises an engaging portion 162 and a joint portion 161 connecting the side wall 12 and the engaging portion 162. The engaging portions 162 of each pair of retainers 16 extend toward each other. In an alternative embodiment, the engaging portions 162 can be formed to be one-piece (not shown). Each engaging portion 162 extends upwardly to level with the upper edge 15 of the side wall 12. The housing 10 comprises two pairs of L-shaped grooves 18 (FIG. 3) and a pair of retaining recesses 19 communicating with adjacent two L-shaped grooves 18.

With reference to FIGS. 1 and 2, each shielding plate 20 comprises an elongated base portion 21, a plurality of soldering sections 27 extending from a lower edge of the base portion 21, a plurality of spring tabs 26 formed at positions over the soldering sections 27 near the lower edge of the base portion 21, a plurality of fitting recesses 22 defined along the lower edge of the base portion 21, a pair of arm portions 25 extending from opposite ends of the base portion 21, and a pair of protrusions 24 provided adjacent to the arm portions 25, respectively. The spring tab 26 extends from the base portion 21 upwardly and slantways and exposes in the receiving space 11 for contacting with a shielding means of a mating complementary connector (not shown). A plurality of fitting beams 23 are formed between adjacent fitting recesses 22 and are secured in engaging grooves 163 defined between the pair of retainers 16 of the housing 10. The soldering sections 27 are soldered on a printed circuit board (not shown) on which the electrical connector 1 is mounted. The arm portions 25 are received in corresponding L-shaped grooves 18.

Each metallic reinforcing plate 30 is received in the retaining recess 19 and includes a housing retaining portion 33, a pair of protrusions 31 provided on the housing retaining portion 33 and a soldering section 32 extending from a lower edge of the housing retaining portion 33. Each housing retaining portion 33 of the reinforcing plates 30 contacts with the arm portions 25 of the shielding plates 20. The protrusions 31 are used to securely connecting the reinforcing plates 30 and the shielding plates 20. The soldering sections 32 are soldered on the printed circuit board.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector comprising:

an insulative housing comprising a pair of opposite, longitudinal side walls, a tongue section extending between the side walls, a receiving space defined between the side walls and the tongue section, and a plurality of passageways defined on opposite sides of the tongue section, each side wall having a plurality of cutouts defined along an upper edge thereof;

a plurality of terminals received in the passageways of the insulative housing;

a pair of shielding plates attached to the side walls of the housing, respectively, each shielding plate having an elongated base portion and a plurality of spring tabs engaging with the cutouts of the housing and exposed in the receiving space; and a pair of reinforcing plates assembled on opposite ends of the housing and connecting with the shielding plates.

2. The electrical connector as claimed in claim 1, wherein at least one pair of retainers extends from an outer face of each side wall, and wherein each retainer comprises an engaging portion and a joint portion connecting the side wall and the engaging portion, each engaging portion extending upwardly to level with the upper edge of the side wall.

3. The electrical connector as claimed in claim 2, wherein the shielding plate comprises a plurality of soldering sections extends from a lower edge of the base portion, and each spring tab is formed at positions over the soldering sections near the lower edge of the base portion.

4. The electrical connector as claimed in claim 2, wherein each shielding plate forms at least one pair of fitting recesses engaging with the joint portions of the at least one pair of retainers and a fitting portion projecting between the at least one pair of fitting recesses, and wherein the at least one pair of retainers define an engaging groove therebetween for receiving the fitting portion.

5. The electrical connector as claimed in claim 4, wherein each shielding plate comprises a pair of arm portions extending from two opposite ends thereof, and the housing has two pairs of L-shaped grooves on two ends for receiving the arm portions, respectively.

6. The electrical connector as claimed in claim 5, wherein each shielding plate defines a plurality of protrusions adjacent to the arm portions.

7. The electrical connector as claimed in claim 6, wherein each reinforcing plate defines a housing retaining portion electrically connecting with the arm portion of the shielding plate and a soldering section for soldering on a printed circuit board, and wherein the housing defines a pair of retaining recesses on the two ends for receiving the housing retaining portions, respectively.

8. The electrical connector as claimed in claim 7, wherein each reinforcing plate defines a plurality of protrusions for securing connection with the shielding plate.

* * * * *